United States Patent [19]

Wong et al.

[11] 4,220,304

[45] Sep. 2, 1980

[54] ATTACHMENT FOR ELECTRIC TORCHES

[75] Inventors: Chung-Chee Wong, Kowloon, Hong Kong; David R. Dalton, Sydney, Australia

[73] Assignees: Sonca Industries Limited, Kowloon, Hong Kong; Union Carbide Australia Limited, Sydney, Australia

[21] Appl. No.: 919,305

[22] Filed: Jun. 26, 1978

[30] Foreign Application Priority Data

Mar. 14, 1978 [GB] United Kingdom ..... 10107/78

[51] Int. Cl.[2] ..... A47B 96/06

[52] U.S. Cl. ..... 248/231; 362/191; 362/205; 362/398

[58] Field of Search ..... 362/205, 398, 191; 248/231

[56] References Cited

U.S. PATENT DOCUMENTS

| | | | |
|---|---|---|---|
| 2,886,664 | 5/1959 | Graubner | 362/398 X |
| 3,713,614 | 1/1973 | Taylor | 362/398 X |

*Primary Examiner*—Stephen J. Lechert, Jr.

*Attorney, Agent, or Firm*—Wenderoth, Lind & Ponack

[57] ABSTRACT

To adapt a new attachment for an electric torch or flashlight of the kind having a generally cylindrical barrel so that it can be magnetically attached to a magnetic surface, an attachment is provided composed of a body shell which is a resilient partial sleeve with one or more magnets secured to it. The shell may be conveniently made from a plastic material tapering in thickness in opposite circumferential directions towards its axially extending edges. The shell snaps over the barrel of the torch and may have an opening for accommodating the switch and the switch housing so as to provide access to the switch and allow precise location of and prevent movement of the shell along the barrel.

3 Claims, 4 Drawing Figures

10
13
14
16
14a
14a
15

10a
4
12
14a
13
15
11
3

10a
11
10
15
13
14

10
12
14
14a

ATTACHMENT FOR ELECTRIC TORCHES

This invention relates to an attachment for an electric flashlight and is more particularly concerned with an attachment for converting an ordinary flashlight into one which can be attached magnetically to a suitable metallic surface.

According to this invention there is provided an attachment for an electric flashlight comprising a body shell which can be attached to the flashlight, and having one or more magnets secured to the body shell.

In one embodiment intended for use with a flashlight having a barrel of generally cylindrical form or having a small angle of conicity along its length wherein the barrel accommodates the flashlight batteries, the body shell of the attachment has a resilient partial sleeve which enables the shell to be snapped over the body of the flashlight to grip the barrel firmly. The shell may be provided with a hole to accommodate a push-button switch and its housing and to provide access to the push-button switch. The engagement between the hole and the switch housing can conveniently prevent the shell from displacement along the barrel.

The body shell is preferably made from a plastic material, and may have a small angle of conicity along its length.

One embodiment of the invention will now be described by way of example. The description makes reference to the accompanying drawings in which.

Figures 1, 2, 3, 4:
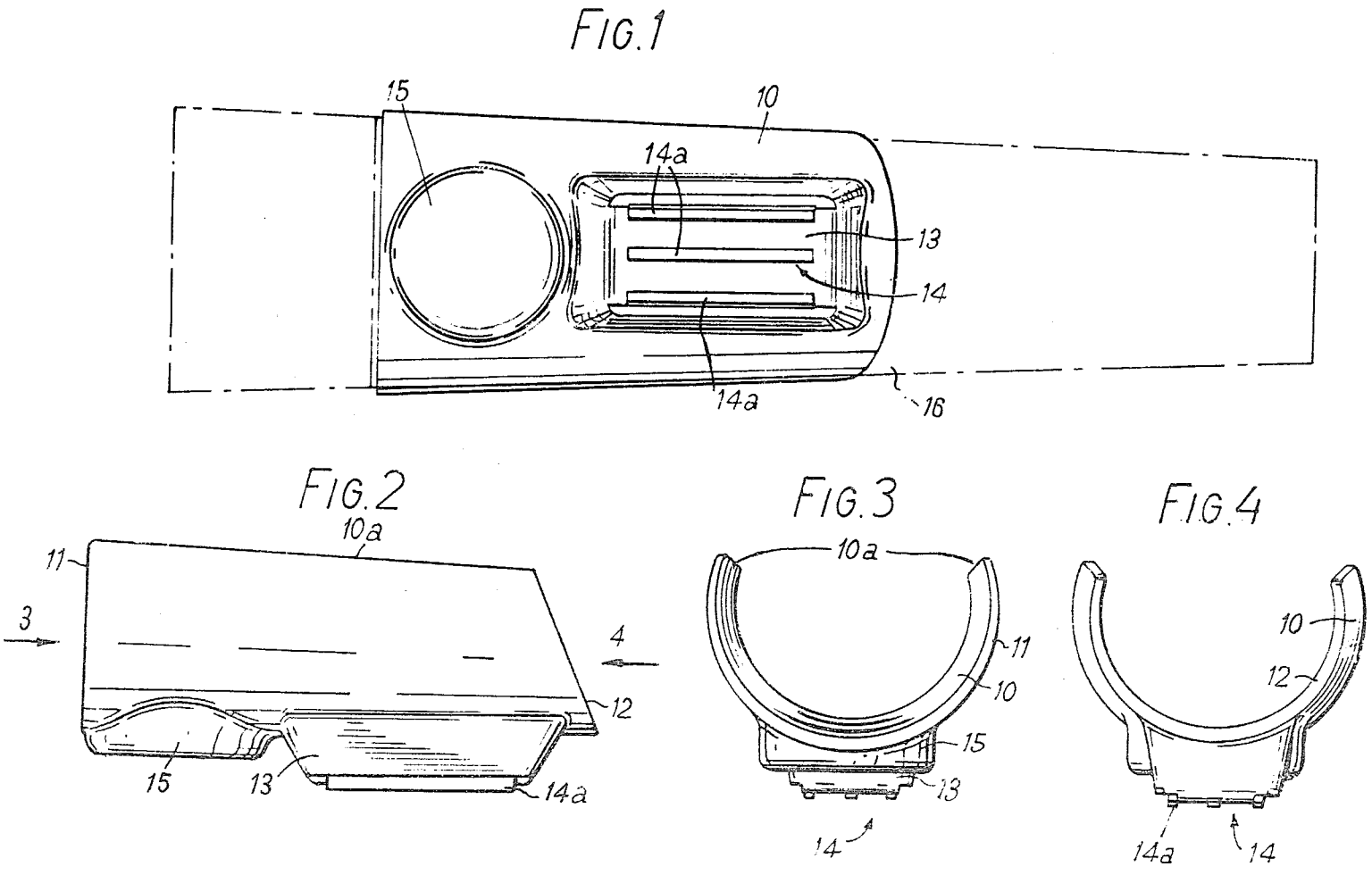
FIG. 1 is a front view of the attachment.
FIG. 2 is a side view of the attachment.

FIGS. 3 and 4 are end views in the direction of the arrows 3 and 4 of FIG. 2.

Referring to the drawings the attachment which is shown enables a flashlight of the kind having a cylindrical barrel in which the flashlight batteries are disposed to be converted into one which can be attached magnetically to a steel or other magnetic supporting surface. The attachment is molded from a resilient plastic material and comprises a body shell in the form of a partial sleeve 10 which has a small angle of conicity so that the sleeve has a greater diameter at its forward end 11 than at its rear end 12. The thickness of the sleeve may taper towards its two axially-extending edges 10*a* as shown in FIG. 3 to assist in obtaining the required resilience. Molded into a boss 13 on the external surface of the sleeve is a magnet assembly 14 of the kind commonly employed in magnetic electric flashlights and magnetic door catches and incorporating two, three or any other convenient number of magnetic bars 14*a*. A second boss 15 surrounds a hole which can accommodate a switch button and its housing and provide access to the switch button.

To secure the attachment to a flashlight the partial sleeve is snapped on to the barrel 16 of the flashlight, so that the switch button housing is disposed in the hole in boss 15 and thus assists in locating the attachment on the flashlight barrel. The conversion is now complete.

It will be clear that there are many possible variations of the attachment shown in the drawings. The boss 15 may be larger to accommodate the housing of a sliding switch or may be omitted entirely; in the latter case the shell can be placed on the flashlight barrel so that the switch is disposed between the axially-extending edges of the shell.

It will be clear that because of its resilience the attachment can be used on flashlight having a wide range of barrel diameters.

We claim:

1. An attachment for converting a conventional electric flashlight into one that can be attached to a magnetic surface, said attachment being attachable to a cylindrical barrel of an electric flashlight having an operating switch and switch housing thereon, said attachment comprising; resilient body shell means having the shape of a partial sleeve for being snapped over said cylindrical barrel for gripping said cylindrical barrel firmly, said resilient body shell means having switch housing surrounding means for accommodating a switch and switch housing therein and preventing said resilient body shell means from axially or rotationally sliding on said barrel and having a hole therein for providing access to said switch, said resilient body shell means further having a protruding portion having one or more magnets attached thereon, and protruding portion projecting from said resilient body shell means for allowing said resilient body shell means to be magnetically attached to a magnetic surface.

2. An attachment as claimed in claim 1, wherein said body shell means is made of a plastic material and has said one or more magnets molded into it.

3. An attachment as claimed in claim 1, wherein said body shell means has a small angle of conicity along its length.

* * * * *